US006829980B2

(12) United States Patent
Sugiura et al.

(10) Patent No.: US 6,829,980 B2
(45) Date of Patent: Dec. 14, 2004

(54) COMPONENT HAVING SLIDE CONTACT AREA OF COMPRESSOR

(75) Inventors: Manabu Sugiura, Kariya (JP); Takahiro Sugioka, Kariya (JP); Akira Onoda, Kariya (JP); Shino Okubo, Kariya (JP); Tomohiro Murakami, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 76 days.

(21) Appl. No.: 10/085,453

(22) Filed: Feb. 27, 2002

(65) Prior Publication Data

US 2002/0159895 A1 Oct. 31, 2002

(30) Foreign Application Priority Data

Feb. 28, 2001 (JP) ..... 2001-054454

(51) Int. Cl.[7] ..... F01B 31/10
(52) U.S. Cl. ..... 92/155; 92/71
(58) Field of Search ..... 92/153, 155, 71

(56) References Cited

U.S. PATENT DOCUMENTS 5,056,417 A 10/1991 Kato et al. ..... 92/71
5,974,946 A 11/1999 Kanou et al. ..... 92/71
6,378,415 B1 * 4/2002 Sugiura et al. ..... 92/155
6,457,399 B1 * 10/2002 Jingu ..... 92/155

FOREIGN PATENT DOCUMENTS

| | | | |
|---|---|---|---|
| EP | 0 890 743 A2 | 1/1999 | F04B/27/08 |
| EP | 0 992 682 A2 | 4/2000 | F04B/27/08 |
| EP | 1 010 771 A1 | 6/2000 | C23C/4/06 |
| EP | 1 106 704 A1 | 6/2001 | C22C/9/06 |
| JP | 59-231181 A | 12/1984 | F04B/25/04 |
| JP | 08-199327 | 8/1996 | C23C/4/04 |
| JP | 09-209926 | 8/1997 | F04B/27/08 |
| JP | 10-008230 | 1/1998 | C23C/4/06 |
| JP | 10-153169 A | 6/1998 | F04B/27/08 |

* cited by examiner

*Primary Examiner*—Edward K. Look
*Assistant Examiner*—Michael Leslie
(74) *Attorney, Agent, or Firm*—Morgan & Finnegan, LLP

(57) ABSTRACT

Lubricating films are formed on end surfaces of a swash plate, respectively. The lubricating films make slide contact with shoes, respectively. The lubricating films are composed of a copper based material containing no lead, and solid lubricant other than lead is contained the copper based material. A good slide contact characteristic may be obtained while using no lead.

2 Claims, 2 Drawing Sheets

COMPONENT HAVING SLIDE CONTACT AREA OF COMPRESSOR

BACKGROUND OF THE INVENTION

1. Field of the Invention

The present invention relates to a component having a lubricating surface formed therein in a compressor.

2. Description of the Related Art

A swash plate type compressor has pistons which reciprocatingly move upon rotation of a swash plate which rotates with a rotating shaft, as disclosed in the Japanese Unexamined Patent Publication No.59-231181, No.8-199327, No.9-209926 and No.10-153169. Shoes are disposed between the front end surface of the swash plate and the piston and between the back end surface of the swash plate and the piston, so that a rotational force of the swash plate is transferred to the pistons via the shoes. The shoes are made of an iron based material and make slide contact with the rotating swash plate, so the slide contact portion between the shoe and the swash plate may possibly abrade or sticking may occur between the shoe and the swash plate. For this reason, it is required to improve the slide contact characteristic of the swash plate to the shoes.

In the art disclosed in the above described respective publication and the Japanese Unexamined Patent Publication No.10-8230, a lubricating surface formed of a copper based material which mainly contains copper is provided on the slide contact portion of the swash plate. Such lubricating surface improves the slide contact characteristic of the swash plate to the shoes.

In order to further improve the sliding property of the swash plate to the shoes, the copper based material contains lead having a low melting point, in the arts disclosed in the Japanese Unexamined Patent Publication No.59-231181 and No.10-153169. The lead contained in the copper based material is softened due to the high temperature caused by the friction between the swash plate and the shoes, and the softened lead appears on the slide contact surfaces between the swash plate and the shoes to increase lubricity of the slide contact surface. In case of the swash plate disclosed in the Japanese Unexamined Patent Publication No.10-8230, a small amount of lead exist as impurities.

However, it is not preferable to use lead which would cause lead poisoning, and it is required to restrict the amount of lead to be used.

SUMMARY OF THE INVENTION

It is an object of the present invention to provide a component of a compressor, which includes a lubricating surface portion in a slide contact area, and in which a good slide contact characteristic may be obtained while using no lead.

In order to achieve the above object, the present invention provides a component of a compressor, the component including a lubricating surface portion in a slide contact area, the lubricating surface portion being formed of a copper based or aluminum based material which does not contain lead but contains solid lubricant other than lead.

The solid lubricant contained in the copper based or aluminum based material improves the slide contact characteristic of the lubricating surface portion when it is exposed to the lubricating surface. Since the solid lubricant other than lead is contained in the copper based or aluminum based material which does not contain lead, the use of lead is avoided.

Preferably, a lubricating film made of a copper based or aluminum based material containing a solid lubricant is provided in the slide contact area to form said lubricating surface portion.

In this case, preferably, the lubricating film is made on a base material by sintering.

The surface of the lubricating film made of the copper based or aluminum based material becomes the lubricating surface.

Preferably, the compressor comprises a swash plate type compressor having a swash plate rotatable with a rotating shaft, a piston, and a shoe disposed between the swash plate and the piston so as to make slide contact with the swash plate and the piston, whereby a rotational motion of the swash plate is transferred to the piston via the shoe to reciprocatingly move the piston, and said component is the swash plate, in which the swash plate has a lubricating surface and the shoe has a lubricating surface to make slide contact with the lubricating surface of the swash plate.

The slide contact area of the swash plate, which makes slide contact with the shoe, is suitable for the area where a lubricating surface is formed.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1C:
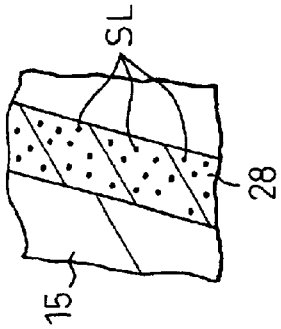
FIG. 1C is a further enlarged cross-sectional view of a portion of the compressor of FIG. 1A.

A specific embodiment of the present invention is now explained with reference to FIGS. 1A to 1C.

Figure 1B:
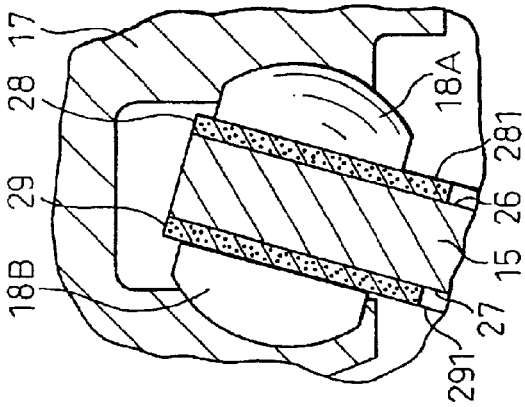
FIG. 1B is an enlarged cross-sectional view of a portion of the compressor of FIG. 1A.
Figure 1A:
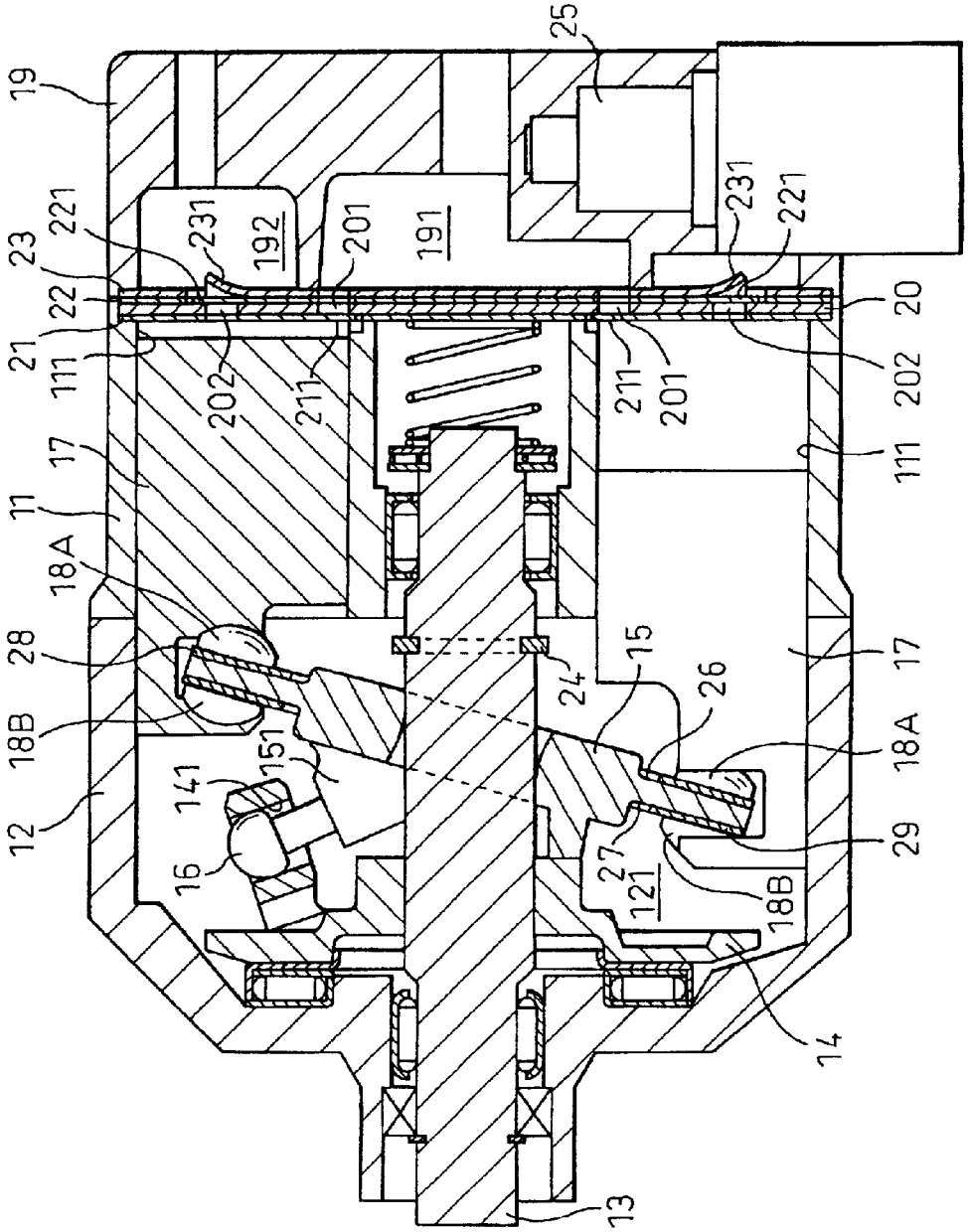
FIG. 1A is a cross-sectional view of a whole compressor according to the first embodiment of the present invention.

FIG. 1A shows the internal structure of a variable displacement compressor. A front housing 12 and a cylinder block 11, which form a pressure control chamber 121, supports a rotating shaft 13. The rotating shaft 13 is supplied with a rotational drive force from an external driving source (e.g., vehicle engine). A rotating supporter 14 is fixed to the rotating shaft 13, and a swash plate 15 is supported by the rotating shaft 13 so as to be able to slide in the axial direction of the rotating shaft 13 and to tilt with respect to the axial direction. A supporter 151 is integrally formed with the swash plate 15 made of an iron based material, and guide pins 16 are fixed to the supporter 151. Guide pins 16 are slidably inserted in guide holes 141 which are formed in the rotating supporter 14. The swash plate 15 can tilt in the axial direction of the rotating shaft 13 and rotate with the rotating shaft 13, by the linkage of the guide pins 16 with the guide holes 141. The tilting motion of the swash plate 15 is guided by the slide guide relation between the guide holes 141 and the guide pins 16 and the slidable support action of the rotating shaft 13.

The angle of inclination of the swash plate 15 may be changed by controlling the pressure in the pressure control chamber 121. As the pressure in the pressure control chamber 121 increases, the angle of inclination of the swash plate 15 decreases, and as the pressure in the pressure control chamber 121 decreases, the angle of inclination of the swash plate increases. The coolant in the pressure control chamber 121 flows out to a suction chamber 191 a the rear housing 19 through a pressure discharge passage (not shown), and the coolant in a discharge chamber 192 in the rear housing 19 is introduced in to the pressure control chamber 121 through a pressure supply passage (not shown). A capacity control valve 25 is disposed in the pressure supply passage, and the flow rate of the coolant supplied from the discharge chamber 192 to the pressure control chamber 121 is controlled by the capacity control valve 25. As the flow rate of the coolant supplied from the discharge chamber 192 to the pressure control chamber 121 increases, the pressure in the pressure control chamber 121 increases, and as the flow rate of the coolant supplied from the discharge chamber 192 to the pressure control chamber 121 decreases, the pressure in the pressure control chamber 121 decreases. That is, the angle of inclination of the swash plate 15 is controlled by the capacity control valve 25.

The maximum angle of inclination of the swash plate 15 is defined as the angle at which the swash plate 15 is in abutment with the rotating supporter 14. The minimum angle of inclination of the swash plate 15 is defined as the angle at which the swash plate 15 is in contact with the circlip 24 on the rotating shaft 13.

The cylinder block 11 has a plurality of cylinder bores 111 (only two are shown in FIG. 1A) which are disposed around the rotating shaft 13. Each cylinder bore 111 accommodates a piston 17. The rotational motion of the swash plate 15 rotating with the rotating shaft 13 is converted into a longitudinal reciprocating motion of the pistons 17 via hemispherical shoes 18A and 18B, whereby the piston 17 moves forward and backward in the cylinder bore 111. The shoe 18A made of bearing steel makes slide contact with one lubricating surface of the swash plate 15, and the shoe 18B made of bearing steel makes slide contact with the other lubricating surface of the swash plate 15.

Due to the backward motion (the motion from right to left in FIG. 1A) of the piston 17, the coolant in the suction chamber 191 flows into the cylinder bore 111 through a suction port 201 in a valve plate 20, pushing open a suction valve 211 in a valve forming plate 21. The coolant flowing into the cylinder bore 111 is then discharged, due to the forward motion (the motion from left to light in FIG. 1A) of the piston 17, into the discharge chamber 192 through a discharge port 202 in the valve plate 20, pushing open the discharge valve 221 in the valve forming plate 22. The opening of the discharge valve 221 is limited by a retainer 231 in a retainer forming plate 23.

As shown in FIGS. 1A and 1B, lubricating films 28 and 29 are formed on the end surfaces 26 and 27 of the swash plate 15, respectively, which are slide contact areas. The lubricating films 28 and 29 are thermal spray layers of a copper (Cu) based material M which includes copper as a main component. The copper based material M contains solid lubricant SL. FIG. 1C schematically shows the state that the copper based material M contains the solid lubricant SL. Surfaces of the lubricating films 28 and 29 are lubricating surfaces 281 and 291 which make slide contact with the shoes 18A and 18B, respectively. Table 1 shows the weight percentages of the components of the lubricating films 28 and 29. Two examples are shown in Table 1. In all examples, solid lubricant SL is contained in the copper based material M. As "other" components of the copper based material M, phosphorus (P) and iron (Fe) are used. As "other" components of the solid lubricant SL, tungsten (W) and chrome (Cr) are used.

TABLE 1

| | M | | | | SL | |
|---|---|---|---|---|---|---|
| | Cu | Sn | Zn | Other | | Other |
| | | | | | $MoO_3$ | |
| No. 1 | 80.325 | 3.485 | 0.425 | 0.765 | 14.94 | 0.06 |
| | | | | | Polyester | |
| No. 2 | 80.01 | 9.09 | 0.18 | 0.72 | 9.98 | 0.02 |

In the first embodiment, the following effect may be obtained.

(1-1) In any one of No.1 and No.2 examples in Table 1, lead (Pb) is not contained. Solid lubricant SL which is used instead of lead improves the slide contact characteristic of the lubricating surfaces 281 and 291 when it is exposed to the lubricating surfaces 281 and 291. Part of the solid lubricant SL which is contained in the lubricant films 28 and 29 is exposed to the lubricating surfaces 281 and 291 since the lubricant films 28 and 29 are made. And the solid lubricant SL in the lubricant films 28 and 29 will outcrop to the surfaces of the lubricant films 28 and 29, i.e. to the lubricating surfaces 281 and 291, due to the abrasion caused by the slide contact between the lubricating films 28 and 29 and the shoes 18A and 18B. That is, the solid lubricant SL contained in the lubricating films 28 and 29 improves the lubricity of the lubricating face 281, 291. In any one of the two examples, the lubricating films 28 and 29 demonstrate the identical degree of good slide contact characteristic to the lubricating film made of the copper based material which contains lead. In addition, since the amount of lead to be used is zero, there would be no problem about environmental health.

(1-2) The end surfaces 26 and 27 of the swash plate 15 on which the lubricating surface portions are formed are under the severe sliding condition, and the end surfaces 26 and 27 of the swash plate 15 require high sliding performance. For this reason, the end surfaces 26 and 27 which are the slide areas of the swash plate 15 where it makes slide contact with the shoes 18A and 18B, are suitable for the areas where the lubricating films 28 and 29 are made.

Figure 2A:
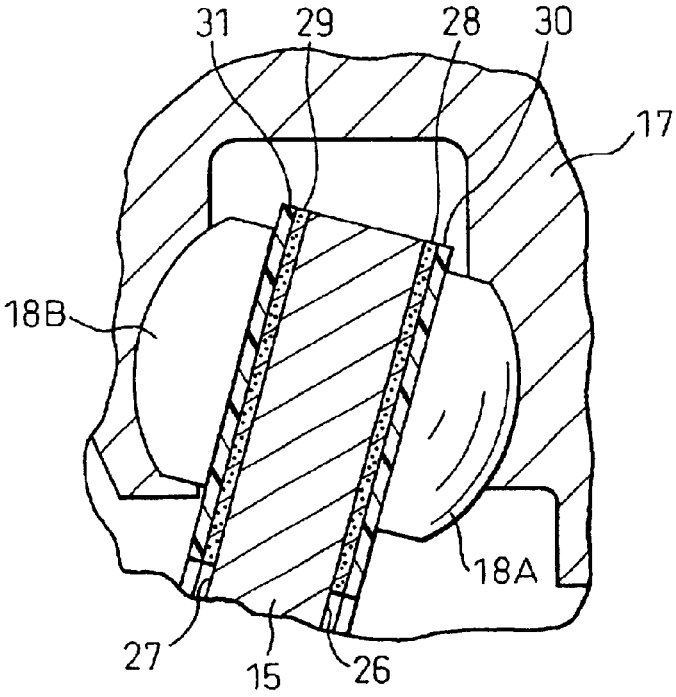
FIG. 2A is an enlarged cross-sectional view of a portion of a compressor according to the second embodiment of the present invention.
Figure 2B:
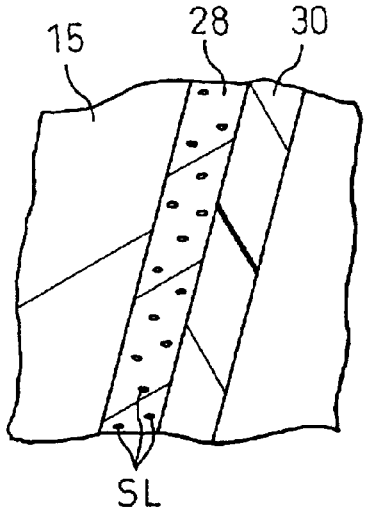
FIG. 2B is a further enlarged cross-sectional view of a portion of the compressor of FIG. 2A.
Figure 3A:
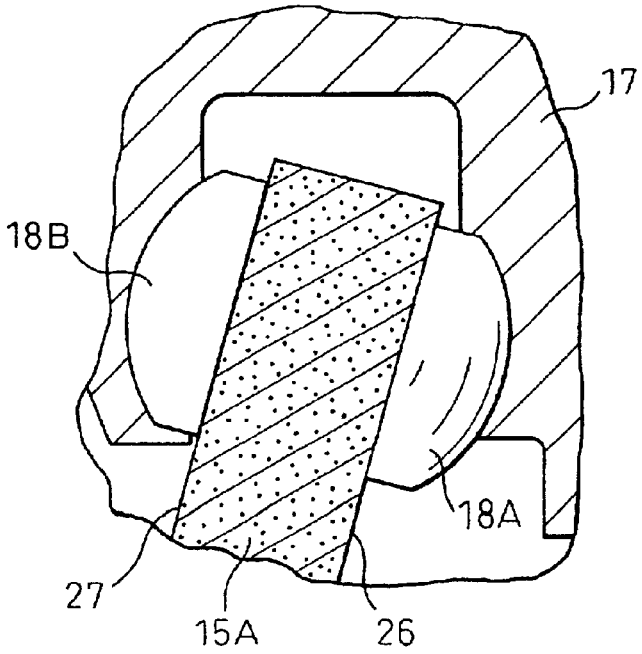
FIG. 3A is an enlarged cross-sectional view of a portion of a compressor according to the third embodiment of the present invention.
Figure 3B:
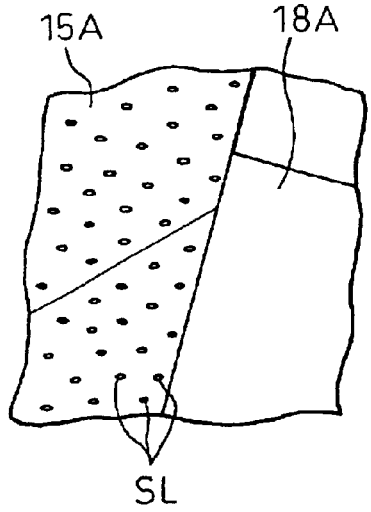
FIG. 3B is a further enlarged cross-sectional view of a portion of the compressor of FIG. 3A.

In the present invention, the second embodiment shown in FIGS. 2A and 2B and the third embodiment shown in FIGS. 3A and 3B are also conceivable. In the second embodiment in FIGS. 2A and 2B, lubricating films 30 and 31 made of resin are provided on the surfaces of the lubricating films 28 and 29 made of metal respectively. In the lubricating films 30 and 31 made of resin, solid lubricant other than lead is scattered. Provision of the lubricating films 30 and 31 made of resin is effective upon the slide contact in the non-lubricant condition.

In the third embodiment in FIGS. 3A and 3B, the swash plate 15A itself is made of a copper based material which does not contain lead, and the copper based material contains solid lubricant SL other than lead. The end surfaces 26 and 27 of the swash plate 15A themselves are lubricating surfaces. The swash plate 15A is made by sintering the powder of the copper based material which contains solid lubricant SL.

In the present invention, the following embodiments are also conceivable.

(l) An embodiment, wherein at least any one of graphite, molybdenum disulfide, boron nitride, tungsten disulfide, carbon fluoride, calcium fluoride, barium fluoride, boron oxide, indium, etc. is used as solid lubricant.

(2) An embodiment, wherein lubricating films 28 and 29 are made on a base material by sintering.

(3) An embodiment, wherein a component of a compressor as a subject of the present invention is made of an aluminum based material, instead of a copper-based material. A lubricating surface portion of the component is formed, by the mixture of an aluminum based material which does not contain lead and a solid lubricant other than lead.

(4) An embodiment, wherein the present invention is applied to the swash plate of a constant displacement swash plate type compressor.

(5) An embodiment, wherein the piston 17 is a component on which a lubricating surface is formed, and the periphery of the piston which makes slide contact with the inner surface of the cylinder bore is the area where the lubricating surface is formed.

The following features can be grasped from the embodiments mentioned above.

(6) The component of the compressor, wherein the component itself is made of a copper based or aluminum based material which contains a solid lubricant.

(7) The component of the compressor, wherein the component itself is made by sintering the powder of a copper based or aluminum based material which contains said solid lubricant.

As described above in detail, in the present invention, solid lubricant other than lead is contained in a copper based or aluminum based material, which does not contain lead, for forming a lubricating surface portion in the slide contact area in a component of a compressor, and thereby good effect may be obtained that slide contact characteristic is good while using no lead.

What is claimed is:

1. A component of a compressor, said component including a lubricating surface portion in a slide contact area, the lubricating surface portion being formed of a copper based metal which does not contain lead but contains solid lubricant other than lead, wherein a lubricating film made of a copper based metal containing a solid lubricant is provided in said slide contact area to form said lubricating surface portion and wherein said lubricating film is made on a base metal by sintering.

2. The component according to claim 1, wherein said compressor comprises a swash plate type compressor having a swash plate rotatable with a rotating shaft, a piston, and a shoe disposed between the swash plate and the piston so as to make slide contact with said swash plate and said piston, whereby a rotational motion of said swash plate is transferred to said piston via said shoe to reciprocatingly move said piston, and said component is said swash plate, in which said swash plate has a lubricating surface and said shoe has a lubricating surface to make slide contact with the lubricating surface of said swash plate.

* * * * *

UNITED STATES PATENT AND TRADEMARK OFFICE

CERTIFICATE OF CORRECTION

PATENT NO. : 6,829,980 B2
DATED : December 14, 2004
INVENTOR(S) : Sugirua et al.

It is certified that error appears in the above-identified patent and that said Letters Patent is hereby corrected as shown below:

Column 3,
Line 12, please delete "191 a the rear" and insert therefore -- 191 at the rear --;
Line 54, please delete "left to light" and insert therefore -- left to right --.

Signed and Sealed this

Fifth Day of April, 2005

JON W. DUDAS
*Director of the United States Patent and Trademark Office*